US006953259B2

(12) United States Patent
Parsons et al.

(10) Patent No.: US 6,953,259 B2
(45) Date of Patent: Oct. 11, 2005

(54) ADJUSTABLE FLASHLIGHT CASE

(75) Inventors: Kevin L. Parsons, Appleton, WI (US); Lester O. Stener, Blaine, MN (US)

(73) Assignee: Armament Systems and Procedures, Inc., Appleton, WI (US)

( * ) Notice: Subject to any disclaimer, the term of this patent is extended or adjusted under 35 U.S.C. 154(b) by 137 days.

(21) Appl. No.: 10/461,153

(22) Filed: Jun. 13, 2003

(65) Prior Publication Data

US 2004/0252494 A1 Dec. 16, 2004

(51) Int. Cl.[7] ..... F21L 4/00

(52) U.S. Cl. ..... 362/191; 362/200; 362/396; 362/398

(58) Field of Search ..... 362/190, 191, 362/200, 208, 287, 396, 398, 427; 248/229.13, 316.7

(56) References Cited

U.S. PATENT DOCUMENTS

| | | | | | |
|---|---|---|---|---|---|
| 4,003,507 | A | | 1/1977 | Elton | |
| 4,170,337 | A | | 10/1979 | Davis | |
| 4,409,645 | A | | 10/1983 | Sloan | |
| 4,586,741 | A | | 5/1986 | Muti | |
| 4,698,732 | A | | 10/1987 | Hickey | |
| 4,855,881 | A | | 8/1989 | Pence | |
| 5,440,465 | A | | 8/1995 | Hasness | |
| 5,460,346 | A | * | 10/1995 | Hirsch | 248/229.13 |
| 5,487,181 | A | | 1/1996 | Dailey et al. | |
| 5,540,368 | A | | 7/1996 | Oliva | |
| 5,593,074 | A | | 1/1997 | Matthews | |
| 5,658,065 | A | | 8/1997 | Jamieson | |
| 5,738,432 | A | * | 4/1998 | Okko et al. | 362/103 |
| 5,752,633 | A | | 5/1998 | Antaki | |
| 5,860,728 | A | * | 1/1999 | Maglica | 362/191 |
| 5,865,357 | A | | 2/1999 | Goodwin | |
| 5,921,657 | A | | 7/1999 | Case | |
| 6,023,875 | A | | 2/2000 | Fell et al. | |
| 6,213,619 | B1 | * | 4/2001 | Yu | 362/103 |
| 6,220,720 | B1 | | 4/2001 | Stephens | |
| 6,231,207 | B1 | | 5/2001 | Kennedy et al. | |
| 6,619,813 | B1 | * | 9/2003 | Schnell | 362/116 |

* cited by examiner

*Primary Examiner*—Y. My Quach-Lee
*Assistant Examiner*—Peggy A. Neils
(74) *Attorney, Agent, or Firm*—Welsh & Katz, Ltd.

(57) ABSTRACT

The invention relates to an adjustable flashlight case for supporting a rectangular shaped flashlight and includes an open front flashlight holder for releasably receiving the flashlight and a U-shaped clip enabling attachment of the case to a support or to the user's person, such as by attachment to an article of clothing or the like. The clip is pivotally connected to the back side of the flashlight holder and has an integral flexible tongue on which is formed a plurality of detent protrusions or nubs for mutual cooperation with a plurality of recesses formed on the holder circumferentially about and concentric to the pivot axis so as to enable pivotal adjustment of the holder relative to the clip, thereby facilitating selective angular orientation of the flashlight beam when supported by the case.

28 Claims, 2 Drawing Sheets

ADJUSTABLE FLASHLIGHT CASE

FIELD OF THE INVENTION

The present invention relates generally to cases for releasably holding light emitting devices, such as flashlights, and more particularly, to an adjustable case for use with a generally rectangular shaped flashlight.

BACKGROUND

Conventional general-purpose flashlights are well known and find wide application by both law enforcement personnel and civilians. Conventional flashlights generally include an incandescent light bulb and dry cell batteries disposed in an elongated generally cylindrical casing typically consisting of a body section and a head section. Flashlights of this type are often bulky and cumbersome. The size and weight of such conventional flashlights inhibit the mobility of law enforcement personnel when carried along with other law enforcement equipment. Many times this results in the flashlight being purposely or inadvertently left behind when an officer is called on to investigate a crime or accident scene or other situation. This presents a problem when the need for a flashlight arises and one is not readily accessible. Similarly, for personal use lighting, conventional bulky flashlights do not lend themselves to being carried at times when conditions suggest that a flashlight be carried on one's person in the event one loses his/her way during walking or hiking in unfamiliar territory, or when backpacking and camping where the weight of equipment is a significant factor.

The problems of weight and bulkiness experienced with prior flashlights that employ elongated tubular barrels which hold one or more cylindrical shaped batteries have been significantly overcome by recent flashlight designs that employ generally small hand-holdable lightweight rectangular shaped housings and that can be readily carried on one's person. See, for example, U.S. patent No. 6,789,917, issue Sep. 14, 2004, that is assigned to the assignee of the present invention and is incorporated herein by reference.

Furthermore, it is of benefit to law enforcement personnel, as well as civilian personnel, that a flashlight be attachable to the user so that the user has both hands free for other activities. Thus, an adjustable case adapted for attachment to a user, such as being attachable to a user's belt or a waist strap or other article of clothing, and that can releasably support a lightweight rectangularly shaped flashlight, such as that disclosed in the aforementioned U.S. patent application, and that is itself compact in size and enables selective directional use of the flashlight while attached to the user, would provide significant advantages over known flashlight cases or carriers. Further, such selective directional use of the flashlight permits the flashlight case to rotate relative to the slide-on clip so that, for example, the flashlight can direct a beam forward of a person to whom the flashlight case is attached. As another example, an officer wearing the adjustable case on his or her belt can rotate the flashlight to a convenient angle to illuminate paperwork in which the officer may be involved.

BRIEF SUMMARY OF THE INVENTION

In accordance with a preferred embodiment of the present invention, an adjustable flashlight case is provided that is of a three-piece, durable inexpensive construction. The flashlight case includes a generally rectangular shaped flashlight holder portion adapted to releasably support a generally rectangular shaped flashlight, a slide-on clip for attaching the case to a support, such as the user's clothing, and a retaining button. The flashlight holder portion is of generally C-shape in transverse cross section so as to define an open side for exposing a switch on the flashlight when disposed within the holder. The flashlight holder has a wall opposite its open side that defines a pivot axis concentric with a circular array of equally circumferentially spaced detent recesses formed in the holder. The slide-on clip comprises a generally U-shaped clip that is pivotally attached to the flashlight holder at the pivot axis and enables releasable attachment of the case to a support member, such as an article of clothing worn by the user. The clip has a tongue formed integral therewith that carries a plurality of detent protrusions or nubs disposed in spaced relation along an arcuate path relative to said pivot axis so as to selectively mate with the detent recesses formed peripherally of the pivot axis. The clip preferably has an opening that both facilitates assembly and enables attachment of an accessory, such as a magnet, which provides an alternate means for attaching the case to a metallic surface of an article.

The tongue is flexible but sufficiently resistant to flexing so that the detent nubs on the tongue are biased into releasable engagement with a corresponding number of detent recesses formed on the holder portion to enable selective rotational positioning of clip about the pivot axis, whereby a light beam from a flashlight supported in the holder can be selectively directed relative to the clip.

The various objects, features and advantages of the present invention will become apparent from the following detailed description of the invention taken in conjunction with the accompanying drawings in which like reference numerals identify like elements throughout the several views.

DETAILED DESCRIPTION

Figure 1:
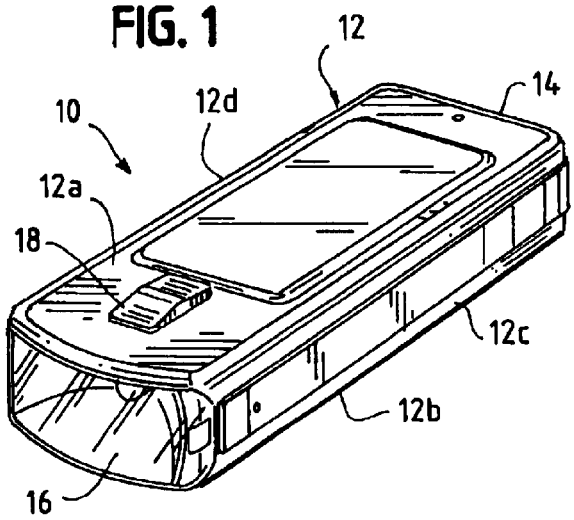
FIG. 1 is a perspective view of a rectangular shaped flashlight of the type for use with an adjustable case constructed in accordance with the present invention.

While the present invention is susceptible of various forms, there is shown in the drawings, and will hereinafter be described, an exemplary and preferred embodiment with the understanding that the present disclosure is to be considered an exemplification of the invention and is not intended to limit the invention to the specific embodiment illustrated and described.

Very generally, an adjustable case constructed in accordance with the present invention is particularly adapted for use with a generally rectangular shaped flashlight. In a preferred embodiment, the adjustable case includes a flashlight holder configured to receive and releasably hold a rectangular flashlight, and a generally U-shaped attachment clip that is pivotally attached to the flashlight holder in a manner enabling attachment of the case to a support or to the user, such as to an article of clothing, and facilitates selective orientation of the flashlight holder and thus the flashlight to selective angular positions relative to the attachment clip.

One type of rectangular flashlight that is useable with the adjustable case of the present invention is indicated at 10 in FIG. 1 and, as aforenoted, is disclosed in U.S. patent No. 6,789,9170, issue Sep. 14, 2004, assigned to the assignee of the present application and incorporated herein by reference. The flashlight 10 includes a generally rectangular housing 12 having parallel upper and lower generally planar walls 12*a, b*. Laterally opposite marginal edges of the upper and lower walls are formed integral with or otherwise affixed to corresponding longitudinal marginal edges of parallel sidewalls 12*c, d*. The rectangular housing 12 has a transverse rear wall 14 and a forward generally transverse lens 16 behind which in the preferred embodiment is light means in the form of a high-intensity lamp and a long life LED crystal light (not shown). Of course, any suitable high-intensity lamp may be used, such as a halogen lamp (Xenon lamp and other gas lamps), high-intensity light LEDs, and the like. The rectangular housing 12 is sized to enable the flashlight to be easily carried in one's hand and has a switch 18 on the upper surface 12*a* selectively operative to connect the high intensity lamp and LED light to respective power sources disposed within the flashlight housing. To this end, the rectangular housing 12 may have a longitudinal length of approximately about four inches, a transverse width of approximately about one and three quarters inches, and a thickness of approximately about three quarters inch.

Figure 2:
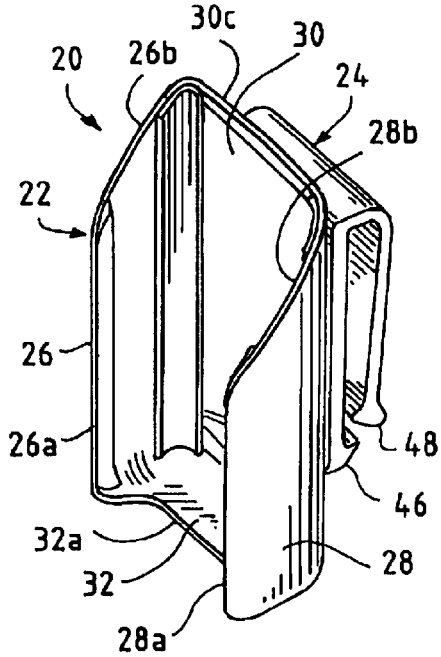
FIG. 2 is a perspective view of an adjustable flashlight case in accordance with the present invention for supporting a generally rectangular shaped flashlight of the type illustrated in FIG. 1.
Figure 3:
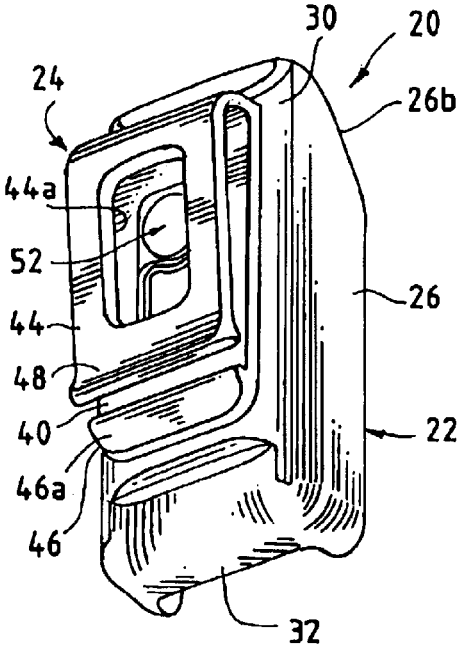
FIG. 3 is a rear perspective view of the flashlight case of FIG. 2.
Figure 4:
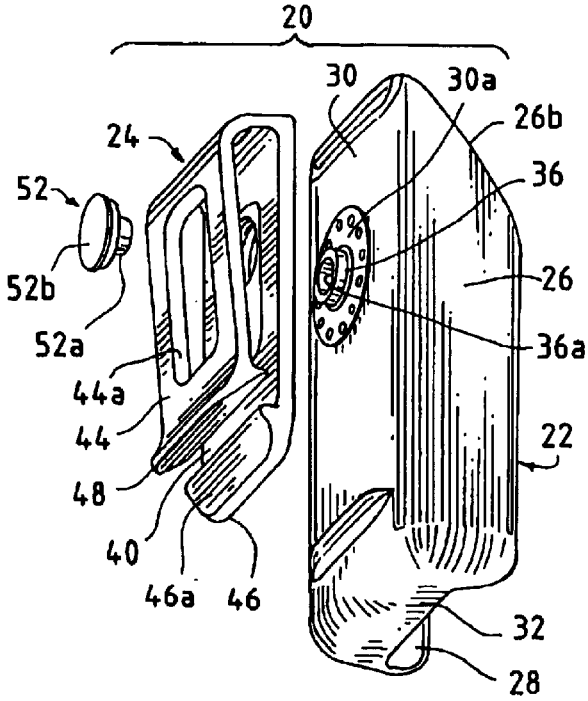
FIG. 4 is an exploded rear perspective view of the flashlight case of FIG. 3.

Referring now to FIGS. 2–4, an adjustable case for receiving and releasably holding a rectangular shaped flashlight in accordance with the present invention is indicated generally at 20. The flashlight case 20, which may alternatively be termed a flashlight carrier, includes a flashlight holder portion 22 configured to receive and releasably hold a rectangular flashlight, and a generally U-shaped attachment clip 24 that is pivotally attached to the flashlight holder. The attachment clip 24 enables attachment of the case to a support, such as a users belt or other item of clothing, and facilitates selective orientation of the holder, and thus a flashlight supported within the holder, to selective angular positions relative to the attachment clip, and thus the user, as will be described. Both the flashlight holder 22 and clip 24 are made of a suitable lightweight material, such as a suitable strength plastic, that lends itself to conventional molding of the various components of the case and can withstand flexing of the flashlight holder as will be described.

Figure 6:
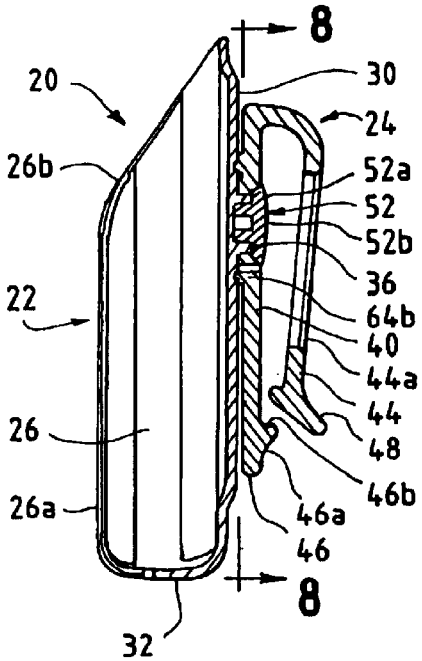
FIG. 6 is a longitudinal sectional view taken substantially along line 6—6 of FIG. 5.

The flashlight holder 22 is of generally C-shaped transverse cross section and, in the illustrated embodiment, has a pair of laterally spaced substantially symmetrical sidewalls 26 and 28 that have external convex or generally arcuate shaped surfaces. The sidewalls 26 and 28 have their rearward longitudinal marginal edges formed integral with or otherwise suitably secured to a generally planar rear or back wall 30 and have forwardly facing laterally marginal edges 26*a* and 28*a* that define a forward opening to the interior of the flashlight holder. A bottom wall 32 is preferably formed integral with the bottom marginal edges of the sidewalls 26 and 28 and a lower marginal edge of the rear wall 30, the sidewalls and bottom wall preferably being contoured to snugly receive the lateral sidewalls and bottom wall of a rectangular shaped flashlight as indicated at 12*a, b* and 14 in the flashlight illustrated in FIG. 1. The upper marginal edges 26*b* and 28*b* of the flashlight holder 20 are preferably inclined downwardly toward the forward opening in the flashlight holder defined between the marginal edges 26*a* and 28*a* so as to facilitate easier insertion and removal of a rectangular flashlight from the holder. The forward opening in the flashlight holder enables a flashlight of the type illustrated in FIG. 1 to be inserted into the flashlight holder with the switch 18 exposed for manual actuation. As shown in FIGS. 2 and 6, the upper marginal edge of the rear wall 30 of the holder is curved inwardly at 30*c* to form a flexible detent-like retaining edge that cooperates with an upper rear transverse marginal edge of the flashlight 10 to releasably lock the flashlight in the holder when fully seated in the holder. The bottom wall 32 has a forward marginal edge 32*a* set back from a plane containing the forward marginal edges 26*a*, 28*a* of the sidewalls 26 and 28 to enable one's fingers to engage the bottom of a flashlight disposed in the holder so as to urge the flashlight upwardly to readily release the flashlight from the case.

Figure 7:
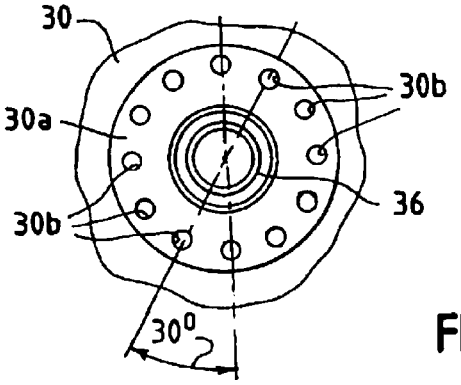
FIG. 7 is a fragmentary detail view, on an enlarged scale, showing the configuration of detent recesses formed on the back side of the flashlight holder portion of the case of FIG. 4.

As will be described in greater detail, the flashlight holder 22 defines a pivot axis on the outer surface of the rear wall 30 established by the center axis of an annular hub 36 preferably formed integral with the rear wall 30 and having its axis disposed normal to the rear wall, as illustrated in FIGS. 4, 6 and 7.

As aforedescribed, the attachment clip 24 enables releasable attachment of the case 20 to a support member or to the user of the flashlight case, such as to an article of clothing worn by the user. For example, the attachment clip 24 is particularly adapted to enable the flashlight case to be attached to a user's belt or a similarly configured strap when disposed about the user's waist. The attachment clip 24 is generally U-shaped in side edge profile and is attached to the flashlight holder 22 through the annular hub 36 in a manner enabling rotational or pivotal adjustment of the flashlight holder 22 relative to the attachment clip 24 when mounted on a support such as the user's belt. As will be described, the attachment clip 24 and flashlight holder 22 are mutually cooperable to enable selective rotational positioning of the holder relative to the clip and facilitate selective directional orientation of the light emitted from a flashlight when supported within the holder.

The attachment clip 24 has a generally planar rectangular wall portion 40 having a circular opening 42 therethrough of a diameter sized to be slidingly received over the annular hub 36 on the holder 22 as illustrated in FIG. 6. As aforedescribed, the attachment clip 24 is preferably made of a suitable plastic material so that the attachment clip can be molded to form an outer resilient or flexible outer arm portion 44 spaced forwardly from the rearward wall 40 and having its upper marginal edge curved rearwardly and formed integrally with an upper marginal edge of the rectangular wall 40 so that the forward arm portion 44 may be flexed relative to the rear wall when attaching and releasing the attachment clip to or from a belt or strap disposed about the user's waist or when attaching and releasing the clip to and from a support member spaced from the user. To facilitate attachment of the clip to a user's belt and release therefrom, the lower free end of the planar wall 40 is preferably formed with a transverse guide 46 having an upwardly and outwardly curved surface 46*a* that facilitates placement of the clip on a belt worn by the user. A transverse edge surface 46*b* prevents inadvertent release or withdrawal of the clip form the belt. A transverse contoured ridge 48 formed on the free end of the arm 44 facilitates griping and outward flexing of the arm 44 for release of the clip and holder from a user's belt.

Figure 5:
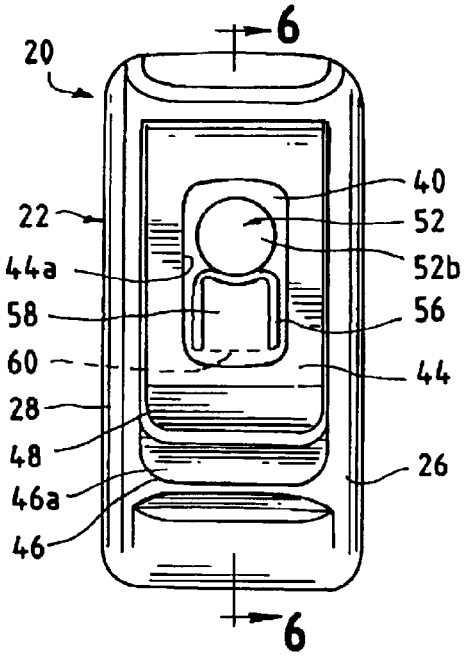
FIG. 5 is a rear elevation view of the case illustrated in FIG. 3.

Referring to FIGS. 5 and 6 taken in conjunction with FIGS. 3 and 4, the arm 44 of the attachment clip 24 has a generally rectangular opening 44*a* therethrough that is sized to facilitate attachment of the clip to the flashlight holder 22. To this end, the rectangular opening 44*a* is made large enough to enable insertion of a retaining knob or button 52 through the arm 44 so that a cylindrical boss 52*a* on the button extends through the opening 42 in the wall portion 40 the clip and into an axially bore 36*a* formed within the annular hub 36. The retaining knob or button 52 is also sized to form an enlarged circular head 52*b* of a diameter greater than the diameter of the circular opening 42 in the planar wall 40 of the clip so as to rotatably retain the clip on the annular hub 36. The retaining knob or button 52 is also made of a suitable plastic material to facilitate sonic welding of the knob within the annular hub 36 while allowing relative rotation between the clip and the flashlight holder 22 as illustrated in FIG. 6. The opening 44*a* also facilitates attachment of an accessory to the arm 44 of the clip, such as a magnet to enable releasable attachment of the flashlight case to a metallic surface of a support member.

Figure 8:
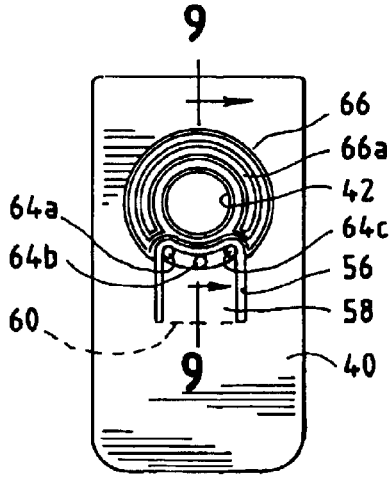
FIG. 8 is an elevational view of the clip portion of the flashlight case taken substantially along line 8—8 of FIG. 6.

Referring now to FIGS. 5–9, the planar wall portion 40 of the attachment clip 24 has a generally U-shaped groove or slot 56 formed therethrough that defines a tongue or finger 58 formed integral with the wall portion 40 and adapted to flex about an axis represented by the dash line 60 in FIGS. 5 and 8.

Figure 9:
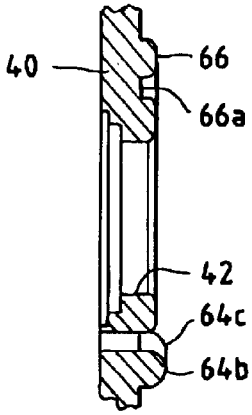
FIG. 9 is a fragmentary longitudinal sectional view, on an enlarged scale, taken substantially along line 9—9 of FIG. 8.

As described at the outset, the attachment clip 24 and flashlight holder 20 have mutually cooperable detent means for enabling selective rotational positioning of the holder relative to the clip. To this end, and as illustrated in FIGS. 6 and 8, taken in conjunction with FIG. 9, the tongue or finger 58 on the clip wall portion 40 has three semi-spherical shaped detent nubs or projections 64*a*–*c* formed on the surface thereof that faces the outer surface of the holder wall 30. The projections 64*a*–*c* lie on an arcuate segment of a circle concentric to the center of the circular opening 42 and are equidistantly spaced apart. A raised hub or boss 66 is formed on the surface 40*a* of the planar wall 40 opposite the outer surface of the wall 30 and takes the form of a portion of a circular hub or boss having a planar surface raised from the surface 40*a* less than the height the projections or nubs 64*a*–*c*, as illustrated in FIGS. 8 and 9. An arcuate channel 66*a* is formed within the hub or boss 66 to reduce the frictional contact between the hub 66 and an opposing circular surface area 30*a* formed on the holder rear wall 30 concentric with the annular hub 36, as illustrated in FIG. 7. The annular planar surface 30*a* has a plurality of semi-spherical detent recesses 30*b* formed therein so that the centers of the recesses lie on a circle concentric to the hub 36 and having a radius substantially equal to the radius of the arc on which the projections 64*a*–*c* are formed. The detent recessed 30*b* are equidistantly circumferentially spaced equal to the arcuate spacing between the projections or nubs 64*a*–*c* on the clip 24 so that the nubs can simultaneous releasably engage three of the detent recessed 30*b* on the holder 22.

With the attachment clip 24 retained on the flashlight holder 22 by the retaining knob or button 52 as aforedescribed, and with the three projections or nubs 64*a*–*c* adapted to engage three of the detent recesses 30*b* in the wall 30 of the holder, the limited flexibility of the tongue or finger 58 biases the projections or nubs 64*a*–*c* into three corresponding detent recesses 30*b* when in registry therewith. The tongue or finger 58 has sufficient flexibility to flex about the axis 60 when the holder 22 is forcefully rotated or pivoted about the pivot axis defined by the annular hub 36 while the attachment clip 40 is held stationary. In this manner, the holder can be selectively rotated or pivoted about its pivot axis to establish a desired orientation between the holder and the attachment clip as desired by the user. For example, with the case 20 mounted on or attached to a user's belt through the attachment clip 24 as aforedescribed, and with a flashlight inserted within the flashlight holder 22, the user can rotate the holder relative to the attachment clip so as to orient the beam of light from the flashlight in a desired direction relative to the attachment clip and thus the user's body. This greatly facilitates use of the flashlight while leaving the hands of the user free for other activities or tasks. This fulfills a need often experienced by law enforcement and security personnel by enabling the flashlight to be selectively directed or oriented relative to the body of the user while leaving both hands free for other activities.

While a preferred embodiment of an adjustable flashlight case in accordance with the present invention has been illustrated and described, it will be understood that changes and modifications may be made therein without departing from the invention in its broader aspects. Various features of the invention are defined in the following claims.

What is claimed is:

1. An adjustable flashlight case for releasably supporting a generally rectangular shaped flashlight, said case comprising:

a flashlight holder for receiving and releasably supporting the rectangular shaped flashlight, said holder defining a pivot axis;

a clip pivotally attached to the flashlight holder at said pivot axis and cooperating with the holder to enable releasable attachment of the case to a support member, said clip defining a flexible tongue;

said tongue and holder having mutually cooperable detent means enabling selective pivotal positioning of said holder relative to said clip about said pivot axis, whereby a lightbeam from a flashlight supported in said holder can be selectively directed relative to said clip.

2. A flashlight case as defined in claim 1 wherein said tongue is formed integral with said clip.

3. A flashlight case as defined in claim 1 wherein said tongue has detent means formed thereon including a plurality of protrusions disposed in predetermined spaced relation along an arcuate path relative to said pivot axis, said holder having a plurality of recesses thereon disposed in predetermined spaced relation along a circular path concentric with said pivot axis, said protrusions on said tongue being biased into releasable engagement with a plurality of said recesses.

4. The adjustable flashlight case as defined in claim 3 wherein said detent means includes three protrusions adapted for simultaneously engaging three recesses of said plurality of recesses on said holder.

5. The adjustable flashlight case as defined in claim 1 wherein said clip comprises a belt clip enabling the flashlight case to be releasably secured to a user's belt.

6. The adjustable flashlight case as defined in claim 4 wherein said clip is U-shaped in side edge profile and has a depending arm having a finger release pad at a free end thereof enabling release of the case from a belt or strap when attached thereto.

7. The adjustable flashlight case as defined in claim 6 wherein said depending arm has an opening therethrough enabling attachment of an accessory to said depending arm.

8. The adjustable flashlight case as defined in claim 7 wherein the attachment comprises a magnet enabling attachment of said case to a metallic support.

9. The adjustable flashlight case as defined in claim 1 wherein the flashlight has an actuating on-off switch button disposed on a major surface thereof, and wherein said flashlight holder is generally C-shaped in transverse cross section to define a flashlight receiving cavity and enabling exposure of the flashlight switch button when the flashlight is supported within the receiving cavity.

10. The adjustable flashlight case as defined in claim 9 wherein the holder has laterally spaced sidewalls having laterally opposed marginal edges defining an opening therebetween to enable exposure of the switch button when supported within the holder.

11. The adjustable flashlight case as defined in claim 10 wherein said sidewalls are fixed to a rear wall having a lower marginal edge configured to enable finger access to the bottom of the flashlight when supported within the holder so as to facilitate removal of the flashlight from the holder.

12. The adjustable flashlight case as defined in claim 10 wherein the holder is sized so that said sidewalls engage laterally opposite side walls of the flashlight when supported within the holder, said holder having a rear wall defining an upper marginal edge adapted for mutual cooperation with an upper transverse edge of the flashlight so as to releasably lock the flashlight in the holder.

13. The adjustable flashlight case as defined in claim 12 wherein said upper marginal edge of said rear wall is curved inwardly toward said receiving cavity.

14. An adjustable flashlight case for releasably supporting a generally rectangular shaped flashlight, said case comprising:

a flashlight holder for receiving and releasably supporting the rectangular shaped flashlight, said holder defining a pivot axis;

a clip pivotally attached to the flashlight holder at said pivot axis and cooperating with the holder to enable releasable attachment of the case to a support member;

said clip defining a tongue formed integral therewith and having detent means formed on said tongue including a plurality of protrusions disposed in predetermined spaced relation along an arcuate path relative to said pivot axis; and said holder having a plurality of recesses thereon disposed in predetermined spaced relation along a circular path concentric with said pivot axis, said protrusions on said tongue being biased into releasable engagement with a plurality of said recesses to enable selective rotational positioning of said holder relative to said chip about said pivot axis, whereby a light beam from a flashlight supported in said holder can be selectively directed relative to said clip.

15. The adjustable flashlight case as defined in claim 14 wherein said clip comprises a belt clip enabling attachment of said flashlight case to a belt or strap disposed about a user's waist.

16. The adjustable flashlight case as defined in claim 15 wherein said clip is U-shaped in side edge profile and has a depending arm having a finger release pad at a free end thereof enabling release of the case from a belt or strap when attached thereto.

17. The adjustable flashlight case as defined in claim 14 wherein said detent means includes three protrusions adapted for simultaneously engaging three recesses of said plurality of recesses on said holder.

18. A flashlight case for use with a flashlight type device, comprising:

a flashlight holder for holding the flashlight type device, the flashlight holder having a pivot location;

a clip pivotally attached to the flashlight holder at the pivot location;

a detent device attached to the clip, the detent device including a tongue having a first end attached to the clip and a second free end, said second end having a plurality of protrusions thereon spaced along a predetermined arc segment; and said holder having a plurality of recesses spaced along a predetermined circular path concentric with the pivot location, the protrusions on said tongue releasably engaging at least some of the recesses of said plurality of recesses to thereby enable positioning of the case in one of the plurality of angular orientations about the pivot location, whereby a flashlight type device held in the holder can be pointed in a selected direction by rotation of the holder about the pivot location to the clip.

19. The adjustable flashlight case as defined in claim 18, wherein the clip comprises a belt clip enabling attachment of the flashlight case to a user's belt or a strap disposed about a user's waist.

20. An adjustable flashlight case for use with a flashlight type device, comprising:

a flashlight holder for holding the flashlight type device, the flashlight holder defining a pivot location;

a clip pivotally attached to the flashlight case at the pivot location, said clip including a tongue having a first end formed integral with the clip and a second free end, said second end having a plurality of protrusions formed thereon spaced along a predetermined arc segment; and said flashlight holder having a plurality of recesses spaced along a predetermined circular path centered about the pivot location axis, the protrusions on said tongue releasably engaging at least some of the recesses of the plurality of recesses on said holder so as to enable positioning of the holder in various angular orientations about the pivot location, whereby the flashlight type device held in the case can be pointed in a selected direction by rotation of the holder abut the pivot location relative to the clip.

21. The adjustable flashlight case as defined in claim 20 wherein said clip comprises a belt clip that enables the adjustable flashlight case to be secured to a belt of a user.

22. An adjustable flashlight case for supporting a rectangular shaped flashlight operative to project a light beam, said case comprising an open front flashlight holder for releasably receiving the flashlight, and a U-shaped clip cooperative with the holder to enable attachment of the case to a support, said clip being pivotally connected to a back side of the flashlight holder at a pivot axis defined on said holder, said clip having an integral flexible tongue on which is formed a plurality of detent protrusions adapted for mutual cooperation with a plurality of recesses formed on the holder circumferentially about and concentric to said pivot axis so as to enable pivotal adjustment of the holder relative to the clip and thereby facilitate selective angular orientation of a flashlight beam from the flashlight when supported by the case.

23. The adjustable flashlight case as defined in claim 22 wherein the flashlight has an actuating on-off switch button disposed on a major surface thereof, and wherein said flashlight holder is generally C-shaped in transverse cross section to define a flashlight receiving cavity and enabling exposure of the flashlight switch button when the flashlight is supported within the receiving cavity.

24. The adjustable flashlight case as defined in claim 23 wherein the holder has laterally spaced sidewalls having laterally opposed marginal edges defining an opening therebetween to enable exposure of the switch bottom when supported within the holder.

25. The adjustable flashlight case as defined in claim 24 wherein said sidewalls are fixed to a rear wall having a lower marginal edge configured to enable finger access to the bottom of the flashlight when supported within the holder so as to facilitate removal of the flashlight from the holder.

26. The adjustable flashlight case as defined in claim 24 wherein the holder is sized so that said sidewalls engage laterally opposite side walls of the flashlight when supported within the holder, said holder having a rear wall defining an upper marginal edge adapted for mutual cooperation with an upper transverse edge of the flashlight so as to releasably lock the flashlight in the holder.

27. The adjustable flashlight case as defined in claim 26 wherein said upper marginal edge of said rear wall is curved inwardly toward said receiving cavity.

28. The adjustable flashlight case as defined in claim 23 wherein said sidewalls having laterally opposed marginal edges defining an opening therebetween to enable exposure of the switch button when the flashlight is supported within the holder.

* * * * *